US010875554B2

(12) United States Patent
Górnioczek et al.

(10) Patent No.: US 10,875,554 B2
(45) Date of Patent: Dec. 29, 2020

(54) WHEEL DETECTOR FOR DETECTING A WHEEL OF A RAIL VEHICLE

(71) Applicant: Bombardier Transportation (ZWUS) Polska Sp. z o. o., Katowice (PL)

(72) Inventors: Marek Górnioczek, Tarnowskie Gory (PL); Dariusz Zielinski, Jaworzno (PL); Andrzej Kopacz, Katowice (PL); Grzegorz Musiol, Bytom (PL); Adam Szczeponik, Chorzow (PL); Kamil Binczyk, Tychy (PL); Wojciech Kolton, Gliwice (PL); Aleksandra Sawodni, Bytom (PL)

(73) Assignee: Bombardier Transportation (ZWUS) Polska Sp. z o. o., Katowice (PL)

( * ) Notice: Subject to any disclaimer, the term of this patent is extended or adjusted under 35 U.S.C. 154(b) by 322 days.

(21) Appl. No.: 16/094,993

(22) PCT Filed: Apr. 27, 2017

(86) PCT No.: PCT/EP2017/060137
§ 371 (c)(1),
(2) Date: Oct. 19, 2018

(87) PCT Pub. No.: WO2017/186886
PCT Pub. Date: Nov. 2, 2017

(65) Prior Publication Data

US 2019/0152499 A1 May 23, 2019

(30) Foreign Application Priority Data

Apr. 28, 2016 (PL) ..... 417024

(51) Int. Cl.
*B61L 1/08* (2006.01)
*B61L 1/16* (2006.01)
*B61L 27/00* (2006.01)

(52) U.S. Cl.
CPC ..... *B61L 1/165* (2013.01); *B61L 1/08* (2013.01); *B61L 1/162* (2013.01); *B61L 27/0061* (2013.01)

(58) Field of Classification Search
CPC .. B61L 1/08; B61L 1/162; B61L 1/163; B61L 1/165; B61L 27/0061
See application file for complete search history.

(56) References Cited

U.S. PATENT DOCUMENTS 3,359,417 A * 12/1967 Gallagher ..... B61L 1/165 246/249
3,840,850 A * 10/1974 Whiteing ..... B60C 23/043 340/448

(Continued)

FOREIGN PATENT DOCUMENTS

DE 19709840 A1 9/1998
EP 1479587 A2 11/2004

(Continued)

*Primary Examiner* — Mark T Le
(74) *Attorney, Agent, or Firm* — The Webb Law Firm

(57) ABSTRACT

Provided is a wheel detector for detecting a wheel of a rail vehicle, including two detector channels. Each channel includes a coil unit which is connected with a measurement and feeding module for feeding the coil unit with an output signal of the measurement and feeding module. A decision module of the respective channel is bi-directionally connected to the measurement and feeding module. The measurement and feeding module of each channel includes a temperature measurement module and/or a module for measurement of mechanical vibration, that is/are connected with an input/inputs of a decision module of the channel. The decision modules are connected via a bidirectional digital interface. The decision module of one channel is connected via a bidirectional digital interface with a data transmission module for communication with a supervisory system via a data transmission line.

10 Claims, 3 Drawing Sheets

(56) References Cited

U.S. PATENT DOCUMENTS

| | | | | | |
|---|---|---|---|---|---|
| 3,964,703 | A * | 6/1976 | Wilkas | B61L 1/08 | 246/34 R |
| 4,518,918 | A * | 5/1985 | Avery | G01D 5/147 | 324/207.2 |
| 4,727,372 | A * | 2/1988 | Buttemer | B61L 1/08 | 246/247 |
| 5,084,674 | A * | 1/1992 | Lachmann | G01P 3/488 | 324/166 |
| 5,260,614 | A * | 11/1993 | Theus | H01L 27/22 | 327/362 |
| 6,371,417 | B1 * | 4/2002 | Southon | B61L 1/165 | 246/247 |
| 6,663,053 | B1 * | 12/2003 | Shams | B61L 5/107 | 246/122 R |
| 2007/0001059 | A1 | 1/2007 | Appleby et al. | | |

FOREIGN PATENT DOCUMENTS

| | | | |
|---|---|---|---|
| EP | 2057056 | A2 | 5/2009 |
| EP | 2218624 | A2 | 8/2010 |
| EP | 2496459 | B1 | 2/2014 |
| PL | 199810 | B1 | 5/2005 |
| PL | 209435 | B1 | 10/2006 |
| WO | 2008138858 | A1 | 11/2008 |
| WO | 2011054646 | A1 | 5/2011 |

* cited by examiner fig.3
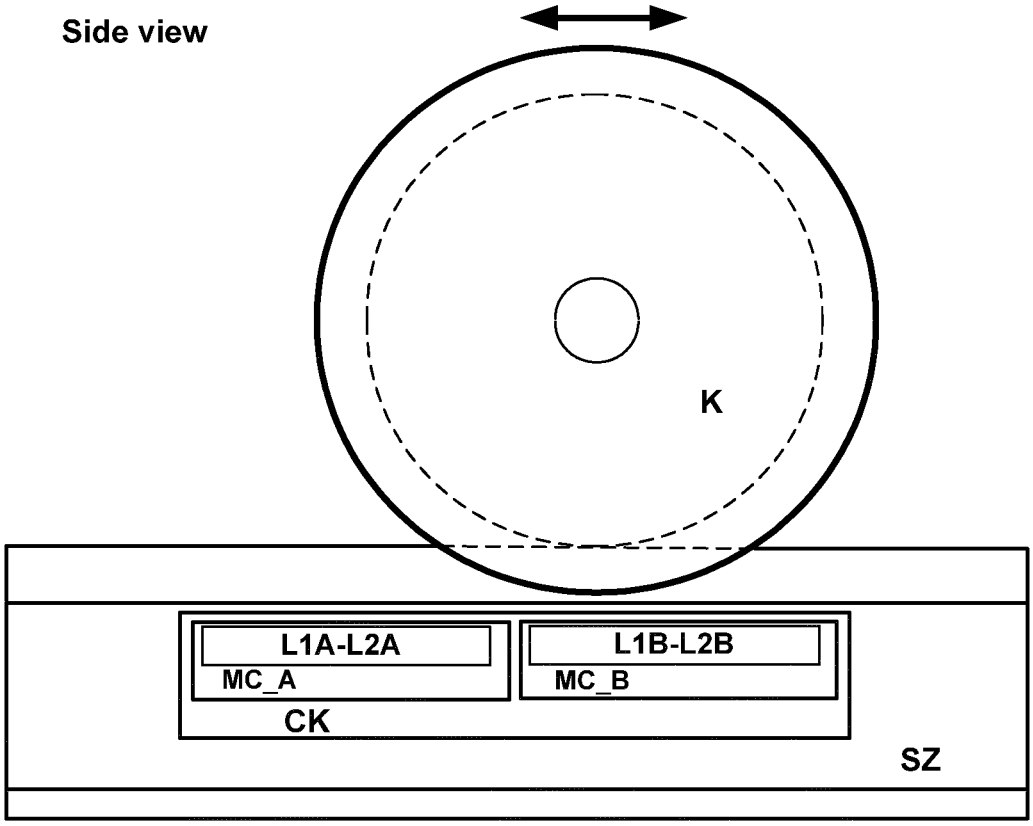
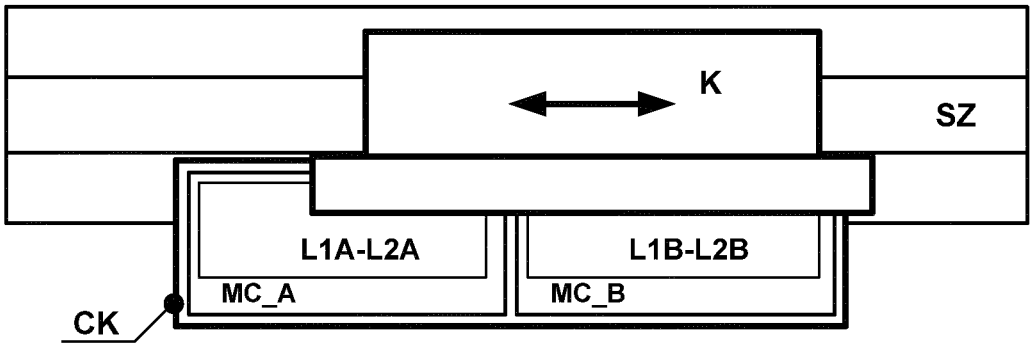
fig.4

WHEEL DETECTOR FOR DETECTING A WHEEL OF A RAIL VEHICLE

CROSS-REFERENCE TO RELATED APPLICATIONS

This application is the United States national phase of International Application No. PCT/EP2017/060137 filed Apr. 27, 2017, and claims priority to Polish Patent Application No. P.417024 filed Apr. 28, 2016, the disclosures of which are hereby incorporated in their entirety by reference.

BACKGROUND OF THE INVENTION

Field of the Invention

The invention relates to a wheel detector for detecting a wheel of a rail vehicle, which in particular can be used at railway stations and railway lines for detecting the lack of track section occupancy, i.e. the absence of vehicles in the track section, in order to manage rail vehicle traffic.

Description of Related Art

Track circuits, wheel detectors and induction loops are used in systems for detecting lack of track section occupancy according to prior art.

One prior art type of wheel detector functions based on analyzing—with the use of a trackside electronic unit—a the signal transmitted by a receiver head of the wheel detector which is located within a the magnetic field that is being generated by a transmitter head of the wheel detector, wherein the heads are mounted on opposite sides of the rail on which a wheel may run and pass the detector.

The Polish Patent Document PL 199810 B discloses an integrated two-channel head of a detector for detecting a rail vehicle wheel, which head has a transmitting head with two resonant capacitive-inductive sets in the form of a parallel (current) resonance circuit and four coil receiving heads. Pairs of the coils of the receiving head are located asymmetrically in relation to coils of the transmitting head. Such an arrangement of the coils in the receiving head ensures that the envelope of the signal is appropriately shaped during the passage of different types of wheels, for example small wheels, untypical wheels or wheels which are moved away from the rail head.

Other Polish Patent Document PL 209435 B discloses a wayside electronic circuit of a detector for detecting a wheel of a rail vehicle, which detector comprises a transmitting part including transmitting heads, a receiving part which includes receiving heads and a microprocessor circuit.

Both the transmitting part and the receiving part have modulators which are controlled by the signals transmitted form the microprocessor circuit, however the modulator in the receiving part is connected with a preamplifier and a change of amplification of the preamplifier is controlled from the microprocessor circuit. The preamplifier is in turn connected with the circuit which multiplies the input signal from the receiving heads by the control signal (command signal) from the microprocessor circuit. The multiplying circuit is connected with a further multiplying circuit which multiplies the input signal from the receiving heads by the signal that feeds the transmitting heads, which is modified in the phase shifter that is controlled from the microprocessor circuit. The signal from the other multiplying circuit is transmitted to the circuit of input signal adder from the receiving heads and the signal from the microprocessor circuit.

The design consisting of only one head which is fastened to a rail and which enables detecting a passage of a wheel flange is another design solution that is implemented in wheel detectors according to prior art. Most frequently the principle of how one-side wheel detectors function is that electric parameters of electric circuits change—e.g. of the resonance circuits that are inside the wheel detectors—in the presence of an electric conductor, here of a wheel. The above mentioned principle of wheel detector functioning with one head is also widely implemented in the designs of metal detectors in a number of different industries. An example of such a technical solution is contained in EP 1479587 A2 according to which two independent inductive sensors are located in a common enclosure—first one and then the other one—lengthwise along the rails. Each of the circuits of the detector comprises a coil of the detector which may or may not have a steel core and comprises an oscillator circuit. A coil of the detector together with a capacitor form an oscillating circuit which generates a variable magnetic field around it. When the wheel flange reaches the zone of operation of the coil of the detector, oscillations of the oscillating circuit will be attenuated as a result of being deprived of energy by the steel wheel flanges due to eddy-currents induced within the wheel. In consequence, the voltage amplitude of the oscillator circuit will change and/or the resonance frequency of the oscillator circuit will change and in the majority of detectors this results into a change of power consumption of the detector for operating the oscillator circuit. A corresponding current signal is transmitted via a two-wire link to a device in the safety installation. There, the signal is transformed e.g. using comparator circuits into the control signals (command signals) and is transmitted for further processing taking account different tasks within the safety installation.

SUMMARY OF THE INVENTION

The invention relates to a wheel detector for detecting a wheel of a rail vehicle which is installed next to the rail head. The purpose of the wheel detector is to detect the passage of a flange of a wheel of a rail vehicle and to transmit data about the passage of the wheel to a supervisory system, e.g. an interlocking system, a level crossing system or a line blocking system. To ensure proper and safe functioning of the wheel detector it is desired to maintain stable parameters of wheel detector performance within the entire spectrum of environmental conditions that occur in the vicinity of a rail. Temperature changes and vibrations are environmental conditions that have an impact on the performance of wheel detectors that are mounted on a rail. The immunity of the wheel detector to electromagnetic interference that is present in the wayside area is a significant feature of the wheel detector.

Due to a large number of variants of rails and a different degree of wear and tear of rails onto which the wheel detector can be mounted, it is advantageous to adjust the parameters of wheel detector performance in the very location of its installation. The adjustment of the wheel detector should guarantee that the parameters declared by the manufacturer of the wheel detector functioning on the types of rails specified by the manufacturer will be fulfilled.

The electric circuit of a wheel detector unit that is consistent with the invention is a two-channel circuit and there is a coil unit in each of the channels of the wheel detector and the coil unit is (in particular unidirectionally) connected with a measurement and feeding module of the respective channel for feeding the coil unit with an output signal of the measurement and feeding module, wherein a decision module of the respective channel is bi-directionally (with respect to the transmission of data and/or signals) connected to the measurement and feeding module.

The measurement and feeding module of each channel comprises a temperature measurement module, e.g. comprising in each case at least one temperature sensor, and a mechanical vibration measurement module, e.g. comprising in each case at least one acceleration sensor, wherein the temperature measurement module and/or vibration measurement module is/are connected with an input/with inputs of a decision module. The at least one acceleration sensor allows for measuring the acceleration, i.e. a quantity characterizing mechanical vibrations. The measured acceleration can be transmitted from the wheel detector to another part (e.g. a so-called upper layer) of the wheel detector system, in particular in order to inform a user if the vibrations are in an acceptable range.

The decision modules of the two channels are connected with one another through a bi-directional digital interface and furthermore the decision module of the first channel is connected via a bi-directional digital interface with the data transmission module in order to guarantee the communication between the wheel detector and the supervisory system via a data transmission line.

In particular, there are two circuits in the coil unit of the first channel and the circuits influence one another via coils that are located along the rail head. The connection and geometrical arrangement of relevant coils in the coil unit in the second channel are the same as the ones that are described in respect of the first channel.

Power supply to both channels of the wheel detector can be, for example, provided by independent power supply blocks that are connected with the power supply line.

The measurement and feeding module of at least one of the channels may comprise an amplifier, an output of the amplifier may be connected with the coil unit of the channel and an input of the amplifier may be connected with an output of the decision module of the channel.

In the coil unit in the first channel of the wheel detector only one of the circuits may be connected with the amplifier output and may be fed by the signal from the amplifier output. The input signal for the amplifier in turn may be acquired from the output of the decision module. The information about the power that the amplifier draws via power supply path is transmitted via a power measurement module to the decision module.

The information about the parameters of the output signal coming from the amplifier is transmitted to the decision module using a parameter measurement module. In the coil unit in the second channel of the wheel detector however only one of the circuits is connected with the output of the amplifier in this channel and is fed by the output signal from this amplifier. The input signal for the amplifier is acquired from the output of the decision module of this channel. The information about the power drawn by the amplifier via the power supply path is transmitted to the decision module via the power measurement module of this channel. The information about the parameters of the output signal coming from the amplifier of this channel is transmitted to the decision module of this channel of the wheel detector via the parameter measurement module.

Modules of the two channels may be located within a common enclosure, in particular including power supply modules, data transmission modules, the measurement and feeding module, the measurement modules and/or the decision modules for analyzing changes in measured temperature and/or measured mechanical vibration. The modules may be located one after another alongside the rail.

BRIEF DESCRIPTION OF THE DRAWINGS

Examples of the invention are illustrated in the Drawing, in which the figures show.

DESCRIPTION OF THE INVENTION

Figure 1:
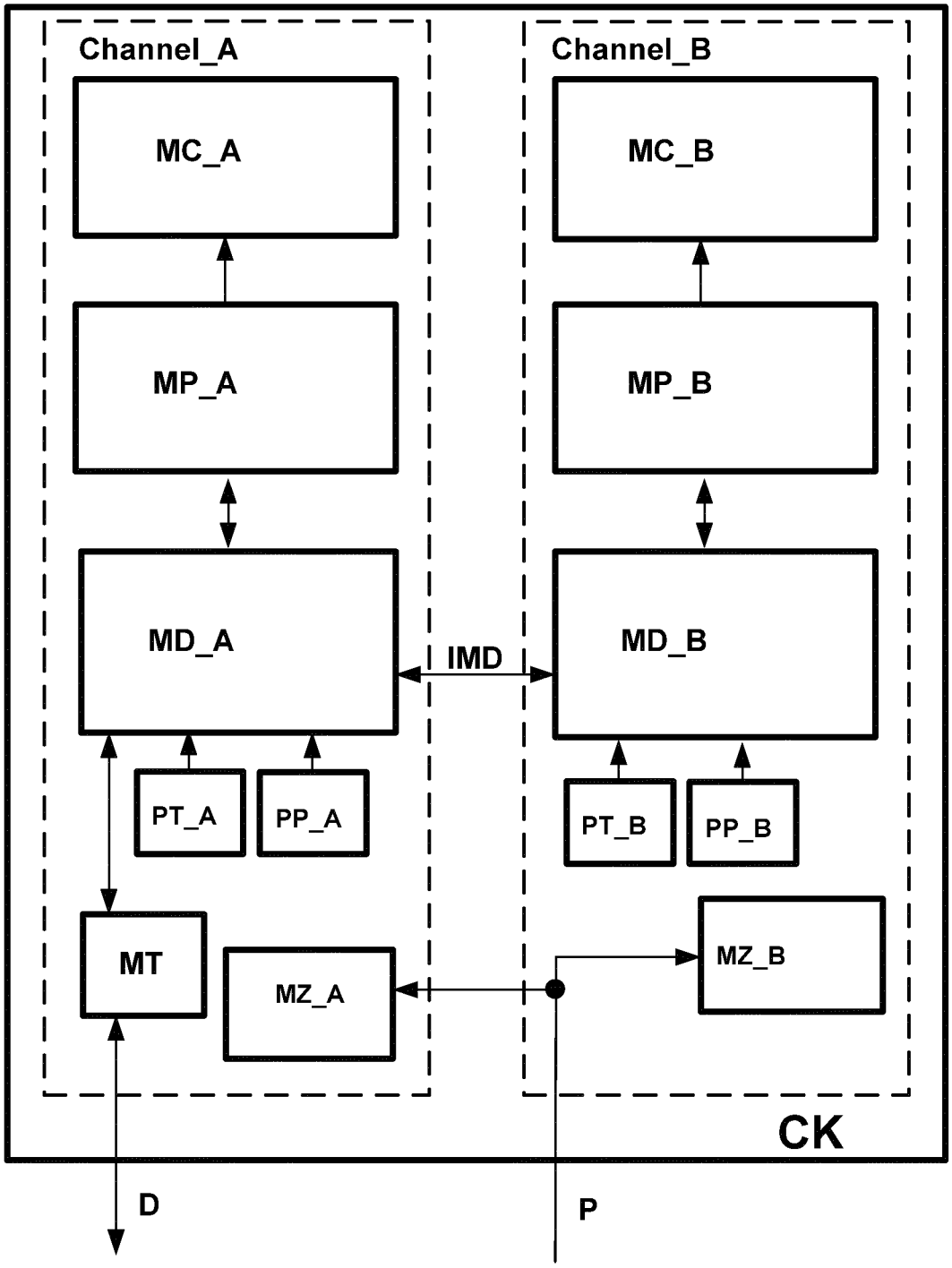
FIG. 1 a block diagram of modules of a wheel detector for detecting wheels of a rail vehicle, FIG. 2 block diagrams of coil units together with block diagrams of measurement and feeding modules in each of the channels of the wheel detector, FIG. 3 a side view of an arrangement of the coil units and inductive items in relation to a rail and FIG. 4 a top view of the arrangement of FIG. 3.

As shown in the Drawing the electric circuit of the wheel detector block i.e. CK is a two-channel circuit. The division of CK wheel detector into two channels A and B is shown in FIG. 1 of the Drawing. There are coil units MC_A and MC_B respectively in each channel of CK wheel detector which are unidirectionally connected with measurement and feeding modules MP_A and MP_B respectively, to which in turn decision modules MD_A and MD_B respectively are connected bi-directionally. Both temperature measurement units PT_A and PT_B respectively and modules for measurement of mechanical vibration PP_A and PP_B respectively are connected to inputs in decision circuits MD_A and MD_B, and at the same time channels A and B are powered respectively by the power supply blocks MZ_A and MZ_B which are connected with power supply line P. Decision modules MD_A and MD_B are connected with each other by means of a bi-directional digital interface IMD, whereas additionally MD_A decision module is connected via bi-directional digital interface with data transmission module MT which ensures communication between the wheel detector and the supervisory system via transmission link D. There is a coil unit MC_A in Channel A of the wheel detector, whereas in channel B there is a coil unit MC_B. Block diagrams of coil units are shown in FIG. 2 in the Drawing.

There are two circuits, i.e. O1_A and O2_A in the coil unit MC_A in the first channel. Circuits O1_A and O2_A influence each other via coils L1A and L2A which are located along the rail head SZ and along the flange of wheel K as shown in FIG. 3 and FIG. 4 in the Drawing. Such a location ensures that the influence of a magnetic field which is generated by the current that flows in the rail and the rolling stock is compensated.

In the coil unit MC_B the connections of relevant circuits O1_B and O2_B and the geometrical arrangement of relevant coils L1B and L2B are the same as in MC_A module. In the coil unit MC_A only one of the circuits O1_A is connected to the output of the amplifier WM_A and is fed by the output signal SWM_A from the amplifier WM_A in accordance with the block diagram which is shown in FIG. 2 of the Drawing.

Figure 2:
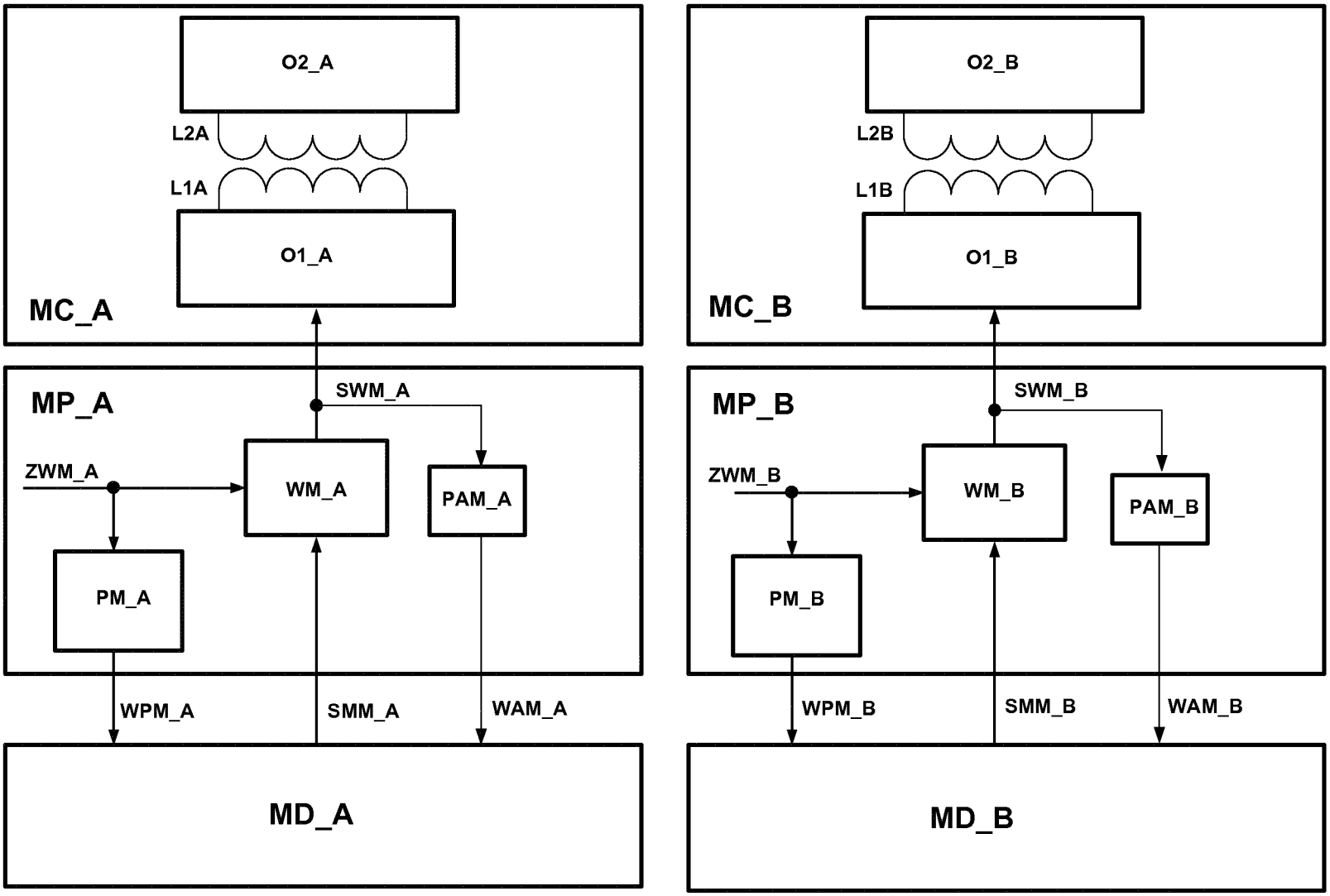

The input signal SMM_A for the amplifier WM_A is acquired from the output of decision module MD_A and this process is presented in a simplified form in FIG. 2 of the Drawing. Data WPM_A about the value of power which is drawn via the power supply path ZWM_A by the amplifier WM_A is transmitted to the decision module MD_A via the power measurement module PM_A and it is shown in FIG. 2 of the Drawing. Data WAM_A about at least one parameter, e.g. an amplitude of a voltage and/or of a current, of the output signal SWM_A from the amplifier WM_A is generated by a parameter measurement module PAM_A and is transmitted from the parameter measurement module PAM_A to a decision module MD_A. This is shown in a schematic form in FIG. 2 of the Drawing.

In the coil unit MC_B only one of the circuits O1_B is connected to the output of the amplifier WM_B and is fed by the signal SWM_B in accordance with the block diagram in FIG. 2 of the Drawing. The input signal SMM_B for the amplifier WM_B is acquired from the output of the decision module MD_B and it is shown in a schematic form in FIG. 2 of the Drawing. Data WPM_B about the value of the power that is drawn via the power supply path ZWM_B by the amplifier WM_B is transmitted via the power measurement module PM_B to the decision module MD_B as it is shown in FIG. 2 of the Drawing. Data WAM_B about at least one parameter, e.g. an amplitude of a voltage and/or of a current of the output signal SWM_B from the amplifier WM_B is generated by a parameter measurement module PAM_B and is transmitted from the parameter measurement module PAM_B to a decision module MD_B. This is shown in a schematic way in FIG. 2 of the Drawing.

There is a transformer L1A-L2A in the coil unit of the first channel MC_A as shown in FIG. 3 and FIG. 4 of the Drawing. The transformer L1A-L2A was created by means of winding of the coils L1A and L2A on the common carcass. Similarly, there is a transformer L1B-L2B in the coil unit of the second channel MC_B and it is also shown in FIG. 3 and FIG. 4 of the Drawing. The transformer L1B-L2B was created by means of winding of the coils L1B and L2B on the common carcass.

Proper fastening of the wheel detector and maintaining unchanged position of the wheel detector during its standard functioning is the prerequisite for proper and safe functioning of this piece of equipment. Standard functioning of the wheel detector shall start after the adjustment process of the wheel detector as defined by the manufacturer has been completed.

The design of the wheel detector enclosure and of the fastening of the wheel detector to a rail guarantees that the transformers L1A-L2A and L1B-L2B are positioned in parallel to the rail and therefore it is possible to effectively compensate the interference generated by the magnetic field that the current flowing in the rail generates—it is presented in a schematic manner in FIG. 3 and FIG. 4 in the Drawing. The design of the enclosure and of the fastening of the wheel detector to the rail enables placing the transformers L1A-L2A and L1B-L2B next to the rail head, on the side on which the wheel flange passes, as shown in FIG. 3 and FIG. 4 of the Drawing. The distance between the transformers and the rail head is defined by the manufacturer.

Furthermore, the design of the enclosure and of the fastening of the wheel detector to the rail makes it possible for positioning the enclosure of the wheel detector within the defined by the manufacturer minimum distance from the top of the rail head, thereby guaranteeing conflict-free functioning of wheel detectors during passage of wheels.

Mounting of the wheel detector on the rail in the position which is defined by the manufacturer, which consists in placing the transformers L1A-L2A and L1B-L2B within the defined distance from the rail head, results in establishing the values of the parameters of electric circuits in coil units MC_A and MC_B and in establishing the indications WPM_A, WPM_B of value of the power drawn. Thanks to maintaining the unchanged position of the wheel detector which is achieved owing to the use of a stable design of a wheel detector fastening, it is ensured that constant values of the electric parameters of the circuits in the coil units MC_A and MC_B are maintained and the constant indications WPM_A, WPM_B of the values of power that is drawn during the period of time between the adjustment and the periodical inspection of the system. It makes it possible to apply the method of cyclic check of the correctness of the position of the wheel detector through cyclic check of the value WPM_A, WPM_B of the power drawn in the algorithm of the wheel detector performance.

A bi-directional digital interface IMD is used in the method of cyclic check of the value WPM_A, WPM_B of power drawn. The bi-directional interface IMD connects the decision modules MD_A and MD_B and enables transmitting the value WPM_A to the decision module MD_B and the value WPM_B to the decision module MD_A. Thanks to transmitting the values WPM_A and WPM_B between the decision modules, each of the decision modules checks the values of the power drawn WPM_A, WPM_B from two channels on a cyclic basis, which makes it possible to reduce the probability of failure to detect the unacceptable change in the position of the wheel detector.

The above described conditions for mounting of the wheel detector on a rail ensure unobstructed movement of the flange of the wheel over the coil units MC_A, MC_B. When an electric conductor in the form of a wheel flange appears above the coil unit MC_A, it leads to the change of the value of the electric parameters of the circuit in this coil unit and the change of the value WPM_A of the power drawn.

When an electric conductor in the form of a wheel flange appears above the coil unit MC_B, it leads to the change of the value of the electric parameters of the circuit in this coil unit and the change of the value WPM_B of the power drawn. The passage of the wheel over the coil units MC_A and MC_B causes generating a sequence of changes in the values of signals WPM_A and WPM_B. One of the conditions of transmitting data about a passage of a wheel from the wheel detector via the data transmission link D is that each of the decision modules MD_A and MD_B detects the passage of a wheel.

The method of detecting the passage of the wheel which is recorded in the algorithms of the performance of decision modules MD_A and MD_B is based on the principle of detecting by each of the decision modules of the sequence of signals WPM_A and WPM_B as defined by the manufacturer.

A bi-directional digital interface IMD is used in the method of detecting the sequence of signals WPM_A, WPM_B as well. The bi-directional interface IMD connects the decision modules MD_A and MD_B and enables transmitting the value WPM_A to the decision module MD_B and the value WPM_B to the decision module MD_A. Thanks to transmitting WPM_A and WPM_B values between the decision modules, each of the decision modules checks the values WPM_A and WPM_B of the power drawn from two channels on a cyclic basis, which makes it possible to reduce the probability of a wrong result of the analysis of the sequence of changes in WPM_A, WPM_B and thereby reduces the probability of detecting improperly the passage of a wheel by the wheel detector thereby leading to low—as required for rail traffic control systems—probability of sending wrong information about passages of wheels to the supervisory system.

The invention claimed is:

1. A wheel detector for detecting a wheel of a rail vehicle, comprising two detector channels, wherein a) each channel comprises a coil unit which is connected with a measurement and feeding module of the respective channel for feeding the coil unit with an output signal of the measurement and feeding module, wherein a decision module of the respective channel bi-directionally connected to the measurement and feeding module, b) the measurement and feeding module of each channel comprises at least one of a temperature measurement module or a module for measurement of mechanical vibration, that is connected with an input of a decision module of the channel, c) the decision modules are connected with each other via a bi-directional digital interface, d) the decision module of one of the channels is connected via a bi-directional digital interface with a data transmission module for communication between the wheel detector and a supervisory system via a data transmission line.

2. The wheel detector of claim 1, wherein each channel is powered during operation by a power supply block which is connectable with a power supply line.

3. The wheel detector of claim 1, wherein the measurement and feeding module of at least one of the channels comprises an amplifier, that an output of the amplifier is connected with the coil unit of the channel and that an input of the amplifier is connected with an output of the decision module of the channel.

4. The wheel detector of claim 3, wherein a first input of the decision module of the channel is connected with a power signal module for transferring a signal about a value of power that is drawn via a power supply path by the amplifier to the decision module of the channel, and/or a second input of the decision module of the channel is connected with a parameter measurement module for transferring a signal to the decision module of the channel about values of an amplitude of a voltage and/or of a current of an output signal from the amplifier to the coil unit.

5. The wheel detector of claim 3, wherein the coil unit of at least one of the channels comprises a pair of electric circuits and one of the circuits is fed by the output signal from the amplifier, whereas the other circuit is powered by a field that is generated by at least one transformer which consists of coils.

6. The wheel detector of claim 2, wherein the measurement and feeding module of at least one of the channels comprises an amplifier, that an output of the amplifier is connected with the coil unit of the channel and that an input of the amplifier is connected with an output of the decision module of the channel.

7. The wheel detector of claim 6, wherein a first input of the decision module of the channel is connected with a power signal module for transferring a signal about a value of power that is drawn via a power supply path by the amplifier to the decision module of the channel, and/or a second input of the decision module of the channel is connected with a parameter measurement module for transferring a signal to the decision module of the channel about values of an amplitude of a voltage and/or of a current of an output signal from the amplifier to the coil unit.

8. The wheel detector of claim 4, wherein the coil unit of at least one of the channels comprises a pair of electric circuits and one of the circuits is fed by the output signal from the amplifier, whereas the other circuit is powered by a field that is generated by at least one transformer which consists of coils.

9. The wheel detector of claim 6, wherein the coil unit of at least one of the channels comprises a pair of electric circuits and one of the circuits is fed by the output signal from the amplifier, whereas the other circuit is powered by a field that is generated by at least one transformer which consists of coils.

10. The wheel detector of claim 7, wherein the coil unit of at least one of the channels comprises a pair of electric circuits and one of the circuits is fed by the output signal from the amplifier, whereas the other circuit is powered by a field that is generated by at least one transformer which consists of coils.

* * * * *